US010795298B2

(12) United States Patent
Hayashi

(10) Patent No.: US 10,795,298 B2
(45) Date of Patent: Oct. 6, 2020

(54) FIXING MEMBER, FIXING DEVICE, PROCESS CARTRIDGE, AND IMAGE FORMING APPARATUS

(71) Applicant: FUJI XEROX Co., Ltd., Tokyo (JP)

(72) Inventor: Shogo Hayashi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/267,989

(22) Filed: Feb. 5, 2019

(65) Prior Publication Data

US 2019/0302658 A1 Oct. 3, 2019

(30) Foreign Application Priority Data

Mar. 28, 2018 (JP) ..... 2018-061272

(51) Int. Cl.
*G03G 15/20* (2006.01)
*G03G 21/18* (2006.01)

(52) U.S. Cl.
CPC ..... *G03G 15/206* (2013.01); *G03G 21/1814* (2013.01)

(58) Field of Classification Search
CPC ..... G03G 15/206; G03G 15/2057; G03G 15/2053; G03G 21/1814
See application file for complete search history.

(56) References Cited

U.S. PATENT DOCUMENTS 6,599,628 B1 * 7/2003 Finsterwalder ..... B32B 37/1207 399/320
2005/0186492 A1 * 8/2005 Yokota ..... G03G 5/142 430/60
2009/0041514 A1 * 2/2009 Maehara ..... C08J 7/045 399/308
2016/0312068 A1 * 10/2016 Kelly ..... G03G 15/2057

FOREIGN PATENT DOCUMENTS

WO 00/060016 A1 10/2000

* cited by examiner

*Primary Examiner* — Hoang X Ngo
(74) *Attorney, Agent, or Firm* — Sughrue Mion, PLLC

(57) ABSTRACT

A fixing member includes: a base containing a polyimide resin; an elastic layer disposed on the base and containing silicone rubber; and a bonding layer that is disposed between the base and the elastic layer, is a cured product of a composition containing an organic titanate compound, and contains a component originating from the organic titanate compound in an amount of from 5% by mass to 95% by mass inclusive.

8 Claims, 4 Drawing Sheets

FIXING MEMBER, FIXING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2018-061272 filed Mar. 28, 2018.

BACKGROUND

(i) Technical Field

The present disclosure relates to a fixing member, to a fixing device, to a process cartridge, and to an image forming apparatus.

(ii) Related Art

In electrophotographic image forming apparatuses (such as copiers, facsimiles, and printers), an unfixed toner image formed on a recording medium is fixed in a fixing device to form an image.

For example, International Publication No. WO/2000/060016 discloses a primer composition for fluorocarbon rubber compositions. This primer composition contains: an organosilane-based polymer having, in its molecular chain, repeating units derived from an alkoxysilane monomer; and 0.001 to 15 parts by weight of an organic titanate compound based on 100 parts by weigh of the solid content of the organosilane-based polymer. It is stated in the International Publication No. WO/2000/060016 that the primer composition can be used for a bonding layer when silicone rubber is coated with a vulcanized fluorocarbon rubber layer.

SUMMARY

In a conventional fixing member in which a base containing a polyimide resin is bonded to an elastic layer containing silicone rubber, repeated fixing operations can cause delamination at the interface between the base and the elastic layer, and therefore the durability of the bond tends to be low. In particular, in a high-temperature high-humidity environment, delamination at the interface between the base and the elastic layer is likely to occur.

Aspects of non-limiting embodiments of the present disclosure relate to a fixing member including: a base containing a polyimide resin; an elastic layer disposed on the base and containing silicone rubber; and a bonding layer disposed between the base and the elastic layer, wherein the durability of the bond between the base and the elastic layer in a high-temperature high-humidity environment is higher than that of a fixing member including a bonding layer that is a cured product of a composition containing only a siloxane polymer having a SiH group and a silane coupling agent.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing member including:

a base containing a polyimide resin;

an elastic layer disposed on the base and containing silicone rubber; and a bonding layer that is disposed between the base and the elastic layer, is a cured product of a composition containing an organic titanate compound, and contains a component originating from the organic titanate compound in an amount of from 5% by mass to 95% by mass inclusive.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described.

Members having substantially the same functions will be denoted by the same numerals in all the figures, and repeated descriptions may be appropriately omitted.

[Fixing Member]

A fixing member according to an exemplary embodiment will be described.

Figure 1:
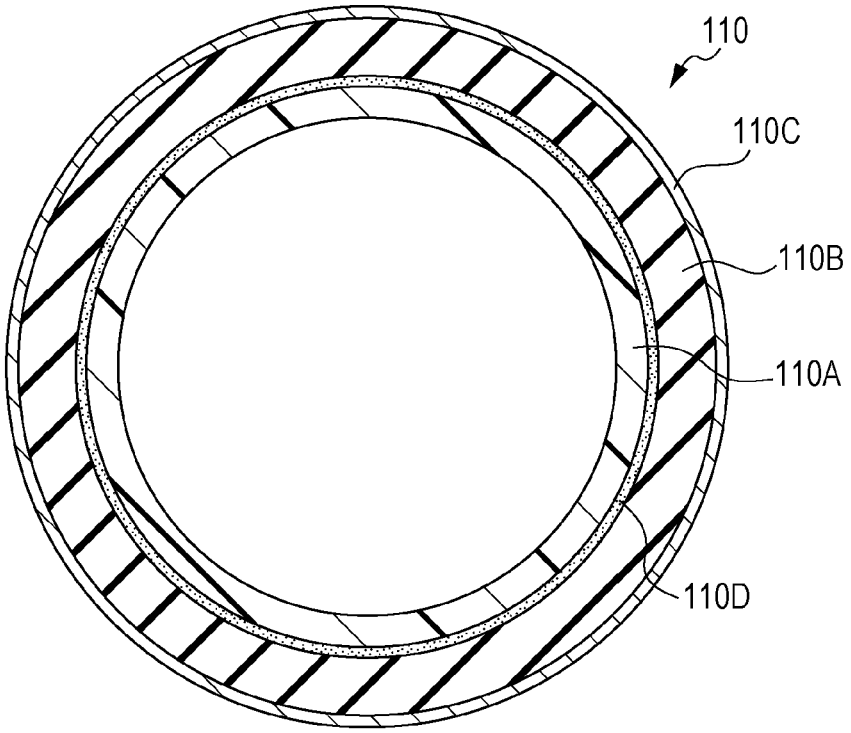
FIG. 1 is a schematic cross-sectional view showing an example of a fixing member according to an exemplary embodiment.

FIG. 1 is a schematic cross-sectional view showing an example of the fixing member according to the present exemplary embodiment.

A fixing member 110 according to a first exemplary embodiment includes, for example; a base 110A; an elastic layer 110B disposed on the base 110A; and a surface layer 110C disposed on the elastic layer 110B, as shown in FIG. 1. The fixing member 110 further includes a bonding layer 110D disposed between the base 110A and the elastic layer 110B.

The elastic layer 110B contains silicone rubber. The bonding layer 110D is a cured product of a compound containing an organic titanate compound and contains a component originating from the organic titanate compound in an amount of from 5% by mass to 95% by mass inclusive.

In the fixing member 110 according to the present exemplary embodiment that has the structure described above, the durability of the bond between the base and the elastic layer in a high-temperature high-humidity environment is high. The reason for this may be as follows.

In a conventional fixing member, a polyimide resin having high flexural strength and high workability is occasionally used as the material of the base 110A.

When the base 110A containing the polyimide resin is bonded to the elastic layer 110B containing the silicone rubber, repeated fixing operations can cause delamination at the interface between the base 110A and the elastic layer 110B, and therefore the durability of the bond tends to be low. In particular, in a high-temperature high-humidity environment, delamination at the interface between the base 110A and the elastic layer 110B is likely to occur.

A polyimide resin has imide bonds formed by imidization, and the number of functional groups such as hydroxyl groups is smaller than that in metal materials etc. When a polyimide resin containing a small number of functional groups is used for the material of the base 110A, the number of functional groups exposed at the surface of the base 110A is small. When a conventional adhesive (containing a siloxane polymer having a SiH group, a silane coupling agent, etc.) is used to bond the base 110A to the elastic layer 110B, the reaction between the adhesive and functional groups present on the surface of the base 110A tends to be insufficient. Therefore, the bond between the base 110A and the elastic layer 110B is insufficient. In this case, even when the initial adhesion is high, the durability of the bond in a high-humidity high temperature environment tends to be low.

The hydrolysis reaction rate of an organic titanate compound is higher than that of a silane coupling agent (such as an alkylsilane), and hydrolysis and dehydration condensation reaction with a small number of functional groups in the base 110A containing the polyimide resin proceed sufficiently.

Therefore, when the bonding layer 110D that is a cured product of a composition containing an organic titanate compound and contains a component originating from the organic titanate compound in an amount of from 5% by mass to 95% by mass inclusive is used to bond the base 110A to the elastic layer 110B, the adhesion between the base and the elastic layer is improved. Therefore, the bond durability in a high-humidity high temperature environment is improved.

For this reason, it is inferred that the fixing member according to the first exemplary embodiment is excellent in durability of the bond between the base and the elastic layer in a high-temperature high-humidity environment.

As shown in FIG. 1, a fixing member 110 according to a second exemplary embodiment includes, for example: a base 110A; an elastic layer 110B disposed on the base 110A; and a surface layer 110C disposed on the elastic layer 110B. The fixing member 110 further includes a bonding layer 110D between the base 110A and the elastic layer 110B.

The elastic layer 110B contains silicone rubber. The bonding layer 110D is a cured product of a composition containing an organic titanate compound.

In the fixing member 110 according to the second exemplary embodiment that has the layer structure described above, when a pressurized hot-water durability test is performed in an environment at a pressure of 0.35 MPa and a temperature of 150° C., the time until the area of bonding between the base 110A and the elastic layer 110B becomes less than 100% is 12 hours or longer.

As described above, in the fixing member 110 according to the second exemplary embodiment, the organic titanate compound having a high hydrolysis reaction rate is used for the bonding layer 110D, and the characteristic that the time until the area of bonding between the base 110A and the elastic layer 110B becomes less than 100% is 12 hours or longer is imparted to the fixing member 110, so that the durability of the bond between the base 110A and the elastic layer 110B is improved.

Therefore, also in the fixing member according to the second exemplary embodiment having the structure described above, the durability of the bond between the base and the elastic layer in a high-temperature high-humidity environment is high.

The layer structure of the fixing members 110 according to the first and second exemplary embodiments is not limited to the above-described layer structure, so long as the layer structure includes the base 110A, the elastic layer 110B, and the bonding layer 110D. Examples of the layer structure that can be used include a layer structure optionally including a metal layer and its protective layer between the base 110A and the elastic layer 110B, a layer structure including a bonding layer between the elastic layer 110B and the surface layer 110C, a layer structure including no surface layer 110C, and combinations of these layer structures.

The structural elements of the fixing members 110 according to the first and second exemplary embodiments (hereinafter collectively referred to as the "present exemplary embodiment" for the sake of convenience) will be described in detail. In the following description, the numerals will be omitted.

(Shape of Fixing Member)

The fixing member according to the present exemplary embodiment is, for example, a belt-shaped member (fixing belt).

(Base)

The base contains the polyimide resin. Specifically, the base used may be a polyimide resin layer. The polyimide resin layer may contain a well-known additive.

No particular limitation is imposed on the polyimide resin, and examples of the polyimide resin include imidized products of polyamic acids (precursors of polyimide resins) that are polymers of tetracarboxylic dianhydrides and diamine compounds. Specific examples of the polyimide resin include a product obtained by subjecting equimolar amounts of a tetracarboxylic dianhydride and a diamine compound to a polymerization reaction in a solvent to obtain a polyamide acid solution and then imidizing the polyamide acid.

Examples of the tetracarboxylic dianhydride include aromatic tetracarboxylic dianhydrides and aliphatic tetracarboxylic dianhydrides. The tetracarboxylic dianhydride may be an aromatic tetracarboxylic dianhydride.

Examples of the aromatic tetracarboxylic dianhydride include pyromellitic dianhydride, 3,3',4,4'-benzophenonetetracarboxylic dianhydride, 3,3',4,4'-biphenylsulfonetetracarboxylic dianhydride, 1,4,5,8-naphthalenetetracarboxylic dianhydride, 2,3,6,7-naphthalenetetracarboxylic dianhydride, 3,3',4,4'-biphenylethertetracarboxylic dianhydride, 3,3',4,4'-dimethyldiphenylsilanetetracarboxylic dianhydride, 3,3',4,4'-tetraphenylsilanetetracarboxylic dianhydride, 1,2,3,4-furantetracarboxylic dianhydride, 4,4'-bis(3,4-dicarboxyphenoxy)diphenylsulfide dianhydride, 4,4'-bis(3,4-dicarboxyphenoxy)diphenylsulfone dianhydride, 4,4'-bis(3,4-dicarboxyphenoxy)diphenylpropane dianhydride, 3,3',4,4'-perfluoroisopropylidenediphthalic dianhydride, 3,3',4,4'-biphenyltetracarboxylic dianhydride, 2,3,3',4'-biphenyltetracarboxylic dianhydride, bis(phthalic acid) phenylphosphine oxide dianhydride, p-phenylene-bis(triphenylphthalic) dianhydride, m-phenylene-bis(triphenylphthalic) dianhydride, bis(triphenylphthalic acid)-4,4'-diphenyl ether dianhydride, and bis(triphenylphthalic acid)-4,4'-diphenylmethane dianhydride.

Examples of the aliphatic tetracarboxylic dianhydride include: aliphatic and alicyclic tetracarboxylic dianhydrides such as butanetetracarboxylic dianhydride, 1,2,3,4-cyclobutanetetracarboxylic dianhydride, 1,3-dimethyl-1,2,3,4-cyclobutanetetracarboxylic dianhydride, 1,2,3,4-cyclopentanetetracarboxylic dianhydride, 2,3,5-tricarboxycyclopentylacetic dianhydride, 3,5,6-tricarboxynorbornane-2-acetic dianhydride, 2,3,4,5-tetrahydrofurantetracarboxylic dianhydride, 5-(2,5-dioxotetrahydrofuryl)-3-methyl-3-cyclohexene-1,2-dicarboxylic dianhydride, and bicyclo[2.2.2]-oct-7-ene-2,3,5,6-tetracarboxylic dianhydride; and aliphatic tetracarboxylic dianhydrides having an aromatic ring such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

Of these, the tetracarboxylic dianhydride is preferably an aromatic tetracarboxylic dianhydride. Specifically, the tetracarboxylic dianhydride is more preferably, for example, pyromellitic dianhydride, 3,3',4,4'-biphenyltetracarboxylic dianhydride, 2,3,3',4'-biphenyltetracarboxylic dianhydride, 3,3',4,4'-biphenylethertetracarboxylic dianhydride, or 3,3',4,4'-benzophenonetetracarboxylic dianhydride, still more preferably pyromellitic dianhydride, 3,3',4,4'-biphenyltetracarboxylic dianhydride, or 3,3',4,4'-benzophenonetetracarboxylic dianhydride, and particularly preferably 3,3',4,4'-biphenyltetracarboxylic dianhydride.

One of these tetracarboxylic dianhydrides may be used alone, or two or more of them may be used in combination.

When two or more tetracarboxylic dianhydrides are used in combination, a combination of aromatic tetracarboxylic dianhydrides or a combination of aliphatic tetracarboxylic dianhydrides may be used, or a combination of an aromatic tetracarboxylic dianhydride and an aliphatic tetracarboxylic dianhydride may be used.

The diamine compound used has two amino groups in its molecule. Examples of the diamine compound include aromatic diamine compounds and aliphatic diamine compounds. The diamine compound may be an aromatic compound.

Examples of the diamine compound include: aromatic diamines such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenylsulfone, 1,5-diaminonaphthalene, 3,3-dimethyl-4,4'-diaminobiphenyl, 5-amino-1-(4'-aminophenyl)-1,3,3-trimethylindan, 6-amino-1-(4'-aminophenyl)-1,3,3-trimethylindan, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl) hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene) bisaniline, 4,4'-(m-phenyleneisopropylidene)bisaniline, 2,2'-bis[4-(4-amino-2-trifluoromethylphenoxy)phenyl] hexafluoropropane, and 4,4'-bis[4-(4-amino-2-trifluoromethyl)phenoxy]-octafluorobiphenyl; aromatic diamines having two amino groups bonded to an aromatic ring and having a heteroatom other than the nitrogen atoms in the amino groups such as diaminotetraphenylthiophene; and aliphatic diamines and alicyclic diamines such as 1,1-m-xylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyclopentadienylenediamine, hexahydro-4,7-methanoindanylenedimethylenediamine, tricyclo[6.2.1.0$^{2,7}$]-undecylenedimethyldiamine, and 4,4'-methylenebis(cyclohexylamine).

Of these, the diamine compound is preferably an aromatic diamine compound. Specifically, for example, the diamine compound is more preferably p-phenylenediamine, m-phenylenediamine, 4,4'-diaminodiphenylmethane, 4,4'-diaminodiphenyl ether, 3,4'-diaminodiphenyl ether, 4,4'-diaminodiphenyl sulfide, or 4,4'-diaminodiphenylsulfone and particularly preferably 4,4'-diaminodiphenyl ether or p-phenylenediamine.

One of these diamine compounds may be used alone, or two or more of them may be used in combination. When two or more diamine compounds are used in combination, a combination of aromatic diamine compounds or a combination of aliphatic diamine combination may be used, or a combination of an aromatic diamine compound and an aliphatic diamine compound may be used.

The number average molecular weight of the polyimide resin is preferably from 5,000 to 100,000 inclusive, more preferably from 7,000 to 50,0000 inclusive, and still more preferably from 10,000 to 30,000 inclusive.

The number average molecular weight of the polyimide resin is measured by gel permeation chromatography (GPC) under the following conditions.

Column: TOSOH TSKgel α-M (7.8 mm I.D.×30 cm)
Eluent: DMF (dimethylformamide)/30 mM LiBr/60 mM phosphoric acid
Flow rate: 0.6 mL/min
Injection amount: 60 μL
Detector: RI (refractive index detector)

The base may contain, in addition to the polyimide resin, well-known additives such as a conducting agent, a filler, and a lubricant.

The thickness of the base is, for example, from 20 μm to 200 μm inclusive, preferably from 30 μm to 150 μm inclusive, and more preferably from 40 μm to 130 μm inclusive.

(Bonding Layer)

The bonding layer is used to bond the base to the elastic layer. The bonding layer is a cured product of a composition containing an organic titanate compound.

—Organic Titanate Compound—

The organic titanate compound may be a titanate having a "Ti—O" structure.

From the viewpoint of improving the durability of the bond between the base and the elastic layer in a high-temperature high-humidity environment, the organic titanate compound is preferably an alkyl titanate and more preferably a tetraalkyl titanate.

More specifically, the organic titanate compound is preferably an organic titanate compound represented by the following general formula (T1) or (T2) and more preferably an organic titanate compound represented by general formula (T1).

General formula (T1): $Ti(OR)_4$

General formula (T2): $(RO)_3Ti—O—Ti(OR)_3$

Here, Rs in these formulas (T1) and (T2) each independently represent an alkyl group.

In formulas (T1) and (T2), the alkyl group represented by R may be a linear, branched, or cyclic alkyl group having from 1 to 24 carbon atoms (preferably from 2 to 20 carbon atoms and more preferably 3 to 12 carbon atoms).

For example, the organic titanate compound is preferably tetramethyl titanate, tetraethyl titanate, tetrapropyl titanate, tetraisopropyl titanate, tetrabutyl titanate, tetraisobutyl titanate, tetrahexyl titanate, tetra(2-ethylhexyl) titanate, tetraoctyl titanate, a butyl titanate dimer, etc., more preferably tetraisopropyl titanate or a butyl titanate dimer, and still more preferably tetraisopropyl titanate.

Other examples of the organic titanate compound include well-known organic titanate compounds such as isopropyl triisostearoyl titanate, isopropyl tridodecylbenzenesulfonyl titanate, isopropyl tris(dioctylpyrophosphate) titanate, tetraisopropyl bis(dioctylphosphite) titanate, tetraoctyl bis(ditridecylphosphite) titanate, tetra(2,2-diallyloxymethyl-1-butyl)bis(ditridecylphosphite) titanate, bis (dioctylpyrophosphate)oxyacetate titanate, bis (dioctylpyrophosphate)ethylene titanate, isopropyl trioctanoyl titanate, isopropyl dimethacryl isostearoyl titanate, isopropyl isostearoyl diacryl titanate, isopropyl tri(dioctylphosphate) titanate, isopropyl tricumylphenyl titanate, isopropyl tri(N-amidoethylaminoethyl) titanate, dicumyl phenyloxyacetate titanate, and diisostearoyl ethylene titanate.

Still other examples of the organic titanate compound include $(n\text{-}C_3H_7O)_3TiOSi(CH_3)(OC_3H_7)_2$, $(n\text{-}C_3H_7O)_3TiOSi(CH_3)_2(OC_3H_7)$, $[(CH_3)_3SiO]_3TiOSi(CH_3)_2(OC_3H_7)_2$, and $[(CH_3)_3SiO]_4Ti$.

One of these organic titanate compounds may be used alone, or two or more of them may be used in combination.

The content of the component originating from the organic titanate compound (the content of the organic titanate compound after reaction) is from 5% by mass to 95% by mass inclusive based on the mass of the bonding layer and is preferably from 10% by mass to 93% by mass inclusive and more preferably from 15% by mass to 90% by mass inclusive, from the viewpoint of improving the durability of the bond between the base and the elastic layer in a high-temperature high-humidity environment.

—Other Components—

From the viewpoint of improving the durability of the bond between the base and the elastic layer in a high-temperature high-humidity environment, the bonding layer may be a cured product of a composition containing the organic titanate compound, a siloxane polymer having a SiH group, and a silane coupling agent.

—Siloxane Polymer Having SiH Structure—

The SiH-containing siloxane polymer is a siloxane compound having at least one SiH structure (i.e., a structure in which a silicon atom is bonded directly to a hydrogen atom) and at least two successive siloxane bonds.

The number of SiH structures included in one molecule of the SiH-containing siloxane polymer is 1 or more. From the viewpoint of the adhesion between the bonding layer and the elastic layer, the number of SiH structures is preferably 2 or more, more preferably from 2 to 100,000 inclusive, and still more preferably from 2 to 50,000 inclusive.

The number of Si atoms included in one molecule of the SiH-containing siloxane polymer is 3 or more. From the viewpoint of improving the adhesion, the number of Si atoms is preferably from 3 to 50,000 inclusive.

The number average molecular weight of the SiH-containing siloxane polymer is, for example, from 200 to 100,000 inclusive and is preferably from 200 to 50,000 from the viewpoint of improving the adhesion.

The number average molecular weight is measured by gel permeation chromatography (GPC). To measure the molecular weight by GPC, the GPC HLC-8120GPC manufactured by TOSOH Corporation is used as a measuring device. The TSKgel Super HM-M (15 cm) column manufactured by TOSOH Corporation is used, and a THF solvent is used. The number average molecular weight is computed from the measurement results using a molecular weight calibration curve produced using mono-dispersed polystyrene standard samples.

The SiH-containing siloxane polymer may have a linear molecular structure, a branched molecular structure, or a cyclic molecular structure.

One example of the SiH-containing siloxane polymer is a compound represented by the following general formula (1).

General formula (1)

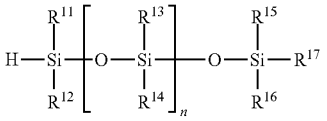

In general formula (1), $R^{11}$, $R^{12}$, $R^{13}$, $R^{14}$, $R^{15}$, $R^{16}$, and $R^{17}$ each independently represent a hydrogen atom or a monovalent organic group, and n represents an integer of 1 or more.

Examples of the monovalent organic groups represented by $R^{11}$ to $R^{17}$ in general formula (1) include substituted and unsubstituted alkyl groups, substituted and unsubstituted aryl groups, and substituted and unsubstituted silyloxy groups.

Examples of the alkyl groups represented by $R^{11}$ to $R^{17}$ in general formula (1) include linear and branched alkyl groups having 1 to 4 carbon atoms (preferably 1 to 3 carbon atoms), and specific examples include a methyl group, an ethyl group, a n-propyl group, an isopropyl group, a n-butyl group, and an isobutyl group.

Examples of the substituents of the alkyl groups represented by $R^{11}$ to $R^{17}$ in general formula (1) include substituted and unsubstituted aryl groups described later and substituted and unsubstituted silyloxy groups described later.

Examples of the aryl groups represented by $R^{11}$ to $R^{17}$ in general formula (1) include a phenyl group and a naphthyl group.

Examples of the substituents of the aryl groups represented by $R^{11}$ to $R^{17}$ in general formula (1) include the substituted and unsubstituted alkyl groups described above and substituted and unsubstituted silyloxy groups described later.

Examples of the substituents of the silyloxy groups represented by $R^{11}$ to $R^{17}$ in general formula (1) include the substituted and unsubstituted alkyl groups described above, the substituted and unsubstituted aryl groups described above, and substituted and unsubstituted silyloxy groups.

From the viewpoint of improving the adhesion, $R^{11}$ to $R^{17}$ in general formula (1) are each preferably a hydrogen atom, an unsubstituted alkyl group having 1 to 2 carbon atoms, an unsubstituted phenyl group, an unsubstituted silyloxy group, or a silyloxy group substituted with an unsubstituted alkyl group having 1 to 2 carbon atoms and more preferably a hydrogen atom or an alkyl group having 1 to 2 carbon atoms.

When n in general formula (1) is 2 or more, two or more $R^{13}$s in the compound represented by general formula (1) may be the same or different and are preferably the same, and $R^{14}$s may be the same or different and are preferably the same.

$R^{13}$ and $R^{14}$ in general formula (1) may be the same or different and are preferably the same. $R^{11}$ and $R^{12}$ in general formula (1) may be the same or different and are preferably the same. $R^{15}$ and $R^{16}$ in general formula (1) may be the same or different and are preferably the same.

In the compound represented by general formula (1), it is preferable that $R^{11}$ to $R^{16}$ are each hydrogen, a methyl group, or an ethyl group and $R^{17}$ is a hydrogen atom, and it is more preferable that $R^{11}$ to $R^{16}$ are each a methyl group and $R^{17}$ is a hydrogen atom.

One SiH-containing siloxane polymer may be used alone, or a two or more SiH-containing siloxane polymers may be used in combination.

From the viewpoint of improving the durability of the bond between the base and the elastic layer in a high-temperature high-humidity environment, the content of the component originating from the SiH-containing siloxane polymer (the content of the siloxane polymer after reaction) is preferably from 5% by mass to 95% by mass inclusive and more preferably from 7% by mass to 90% by mass inclusive based on the mass of the bonding layer.

The content of the component originating from the SiH-containing siloxane polymer based on 100 parts by mass of the component originating from the organic titanate compound is preferably from 5 parts by mass to 95 parts by mass inclusive and more preferably from 10 parts by mass to 93 parts by mass inclusive.

Silane Coupling Agent

The silane coupling agent may be a compound in which at least one of an alkoxy group and a halogen atom is bonded directly to a Si atom.

The silane coupling agent is preferably a silane coupling agent having an alkoxy group and particularly preferably alkoxysilane. Tetraalkoxysilane is a compound in which four alkoxy groups are bonded to a Si atom and is represented by the following general formula (2).

General formula (2)

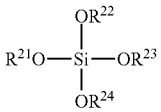

In general formula (2), $R^{21}$, $R^{22}$, $R^{23}$, and $R^{24}$ each independently represent a substituted or unsubstituted alkyl group.

Examples of the alkyl groups represented by $R^{21}$ to $R^{24}$ in general formula (2) include linear and branched alkyl groups having 1 to 4 carbon atoms (preferably 1 to 3 carbon atoms), and specific examples include a methyl group, an ethyl group, a n-propyl group, an isopropyl group, a n-butyl group, and an isobutyl group.

Examples of the substituents of the alkyl groups represented by $R^{21}$ to $R^{24}$ in general formula (2) include linear and branched alkoxy groups, and specific examples include a methoxy group, an ethoxy group, a propoxy group, an isopropoxy group, a butoxy group, and an isobutoxy group.

From the viewpoint of improving the adhesion, $R^{21}$ to $R^{24}$ in general formula (2) are each preferably an unsubstituted alkyl group, more preferably a methyl group, an ethyl group, or a n-propyl group, still more preferably a methyl group or an ethyl group, and particularly preferably a methyl group.

$R^{21}$ to $R^{24}$ in general formula (2) may be the same or different and are preferably the same.

The tetraalkoxysilane represented by general formula (2) is preferably a compound in which $R^{21}$ to $R^{24}$ are each a methyl group or an ethyl group and more preferably a compound in which $R^{21}$ to $R^{24}$ are each a methyl group.

The silane coupling agent may be a silane coupling agent having an alkenyl group (hereinafter may be referred to as an "alkenyl-based silane coupling agent").

Examples of the alkenyl group include alkenyl groups having 2 to 4 carbon atoms, and specific examples include a vinyl group, an allyl group, and a butenyl group. The alkenyl group may be an alkenyl group having a double bond at its end.

Specific examples of the alkenyl-based silane coupling agent include vinyltrimethoxysilane, vinyltriethoxysilane, vinyltriisopropoxysilane, vinyl tris(methoxyethoxy)silane, vinyltrichlorosilane, and allyltrimethoxysilane.

The alkenyl-based silane coupling agent is particularly preferably a compound which has an alkenyl group and in which three alkoxy groups are bonded directly to a Si atom.

The alkenyl-based silane coupling agent may be a compound represented by the following general formula (3).

General formula (3)

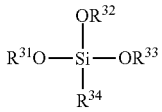

In general formula (3), $R^{31}$, $R^{32}$, and $R^{33}$ each independently represent a substituted or unsubstituted alkyl group, and $R^{34}$ represents a monovalent organic group having an alkenyl group.

Examples of the substituted or unsubstituted alkyl groups represented by $R^{31}$ to and $R^{33}$ in general formula (3) include the same alkyl groups as the substituted and unsubstituted alkyl groups represented by $R^{21}$ to $R^{24}$ in general formula (2).

$R^{31}$ to $R^{33}$ in general formula (3) may be the same or different and are preferably the same.

Examples of the monovalent organic group having an alkenyl group and represented by $R^{34}$ in general formula (3) include alkenyl groups, alkenyloxyalkyl groups, alkenylcycloalkyl groups, and alkenylaryl groups.

The monovalent organic group having an alkenyl group and represented by $R^{34}$ in general formula (3) is preferably an alkenyl group, more preferably an alkenyl group having a double bond at its end, still more preferably a vinyl group, an allyl group, or a 3-butenyl group, and particularly preferably a vinyl group.

The alkenyl-based silane coupling agent represented by general formula (3) is preferably a compound in which $R^{31}$ to $R^{33}$ are each a methyl group or an ethyl group and $R^{34}$ is a vinyl group or an allyl group and is more preferably a compound in which $R^{31}$ to $R^{33}$ are each a methyl group and $R^{34}$ is a vinyl group.

Other examples of the silane coupling agent include well-known coupling agents such as epoxy group-based silane coupling agents, amino group-based silane coupling agents, methacrylic group-based silane coupling agents, styryl group-based silane coupling agents, and amino group-based silane coupling agents.

One silane coupling agent may be used alone, or two or more silane coupling agents may be used in combination.

From the viewpoint of improving the durability of the bond between the base and the elastic layer in a high-temperature high-humidity environment, the content of the component originating from the silane coupling agent (the content of the siloxane polymer after reaction) based on the mass of the bonding layer is preferably from 5% by mass to 95% by mass inclusive and more preferably from 10% by mass to 90% by mass inclusive.

The content of the component originating from the silane coupling agent based on 100 parts by mass of the component originating from the organic titanate compound is preferably from 5 parts by mass to 95 parts by mass inclusive and more preferably from 10 parts by mass to 90 parts by mass inclusive.

The content of the component originating from the silane coupling agent based on 100 parts by mass of the component originating from the SiH-containing siloxane polymer is, for example, from 10 parts by mass to 500 parts by mass inclusive and preferably from 20 parts by mass to 300 parts by mass inclusive.

Additional Components

Examples of the additional components include well-known additives such as reinforcing fillers (e.g., silica, iron oxide, and cerium oxide).

(Characteristics of Bonding Layer)

In the bonding layer, the content of the component originating from the organic titanate compound may be higher on the base side than on the elastic layer side. In this structure, the adhesion of the bonding layer to the base containing the polyimide resin is high, and the durability of the bond between the base and the elastic layer in a high-temperature high-humidity environment is easily improved.

In the bonding layer, the content of the component originating from the organic titanate compound may vary stepwise in the direction of the thickness of the bonding layer or may vary gradually.

From the viewpoint of improving the durability of the bond between the base and the elastic layer in a high-temperature high-humidity environment, the content of the component originating from the organic titanate compound on the base side is preferably from 60% by mass to 95% by mass inclusive and more preferably from 65% by mass to 93% by mass inclusive.

From the viewpoint of improving the durability of the bond between the base and the elastic layer in a high-temperature high-humidity environment, the difference between the content of the component originating from the organic titanate compound on the base side and the content on the elastic layer side is preferably from 30% by mass to 95% by mass inclusive and more preferably from 40% by mass to 90% by mass inclusive.

Examples of the method for forming the structure in which the content of the component originating from the organic titanate compound is higher on the base side than on the elastic layer side include: 1) a method including depositing adhesive-forming compositions with different organic titanate compound contents and then curing the compositions; and 2) a method including depositing adhesive-forming compositions with different organic titanate compound contents using, for example, an inkjet method while the injection amounts of the compositions are changed and then curing the compositions.

The content of the component originating from the organic titanate compound on the base side means the content at a position 0.01 μm from the interface between the base and the bonding layer. The content of the component originating from the organic titanate compound on the elastic layer side means the content at a position 0.01 μm from the interface between the elastic layer and the bonding layer.

The content of the component originating from the organic titanate compound means the average of the content of the component originating from the organic titanate compound on the base side and the content of the component originating from the organic titanate compound on the elastic layer side.

In the bonding layer, the content of the component originating from each compound is measured by, for example, X-ray photoelectron spectroscopy (XPS) analysis in the depth direction with ion etching using an ion gun or by XPS analysis on a sample having a surface inclined 10° prepared using a surface and interfacial cutting analysis system (SA-ICAS).

The thickness of the bonding layer is, for example, from 0.1 μm to 10 μm inclusive and is preferably from 0.2 μm to 7 μm and more preferably from 0.3 μm to 5 μm inclusive.

(Elastic Layer)

The elastic layer contains silicone rubber. Specifically, the elastic layer may be a silicone rubber layer.

Examples of the silicone rubber include dimethyl silicone rubber (MQ), methyl vinyl silicone rubber (VMQ), and methylphenyl silicone rubber (PMQ).

The silicone rubber may be methyl vinyl silicone rubber (VMQ).

The methyl vinyl silicone rubber (VMQ) may be a polymer of a first polysiloxane having a hydrogen-bonded silyl group including a hydrogen atom bonded to a silicon atom and a second polysiloxane having a vinyl group (the polymer may hereinafter be referred to as a "specific silicone rubber").

The first polysiloxane used for the specific silicone rubber will be described.

No particular limitation is imposed on the first polysiloxane having a hydrogen-bonded silyl group (—SiH), and a well-known material may be used. In the first polysiloxane, the hydrogen-bonded silyl group (—SiH) may be present at an end of the main chain or in a side chain of the main chain.

Examples of the first polysiloxane include: organopolysiloxane having a $—SiH(R^1)_2$ group at one or both ends of its main chain (where $R^1$ represents a hydrogen atom or an organic group and is preferably a methyl group, and two $R^1$s may be the same or different); and organohydrogenpolysiloxane including a hydrogen atom bonded to a Si atom included in its main chain (i.e., having a $—[O—Si(—H)(—R^2)]—$) structure in the main chain) (where $R^2$ represents a hydrogen atom or an organic group and is preferably a methyl group).

More specific examples of the first polysiloxane include organohydrogenpolysiloxanes such as methylhydrogenpolysiloxane capped at both ends with trimethylsiloxy groups, dimethylsiloxane capped at both ends with trimethylsiloxy groups/methylhydrogensiloxane copolymers, dimethylpolysiloxane capped at both ends with dimethylhydrogensiloxy groups, dimethylsiloxane capped at both ends with dimethylhydrogensiloxy groups/methylhydrogensiloxane copolymers, methylhydrogensiloxane capped at both ends with trimethylsiloxy groups/diphenylsiloxane copolymers, and methylhydrogensiloxane capped at both ends with trimethylsiloxy groups/diphenylsiloxane/dimethylsiloxane copolymers.

One of these first polysiloxanes may be used alone, or two or more of them may be used in combination.

The second polysiloxane used for the specific silicone rubber will be described.

No particular limitation is imposed on the second polysiloxane having a vinyl group ($—CH{=}CH_2$), and a known material may be used. In the second polysiloxane, the vinyl group may be present at an end of its main chain or in a side chain of the main chain.

Examples of the second polysiloxane include: organopolysiloxane having a vinyl group (—CH=$CH_2$) bonded to a silicon atom (Si) at one or both ends of the main chain; and organopolysiloxane having a vinyl group (—CH=$CH_2$) bonded to a Si atom included in the main chain so as to form a side chain.

More specific examples of the second polysiloxane include organopolysiloxanes such as methylvinylpolysiloxane capped at both ends of its molecular chain with trimethylsiloxy groups, dimethylsiloxane capped at both ends of its molecular chain with trimethylsiloxy groups/methylvinylsiloxane copolymers, dimethylsiloxane capped at both ends of its molecular chain with trimethylsiloxy groups/methylvinylsiloxane/methylphenylsiloxane copolymers, dimethylpolysiloxane capped at both ends of its molecular chain with dimethylvinylsiloxy groups, methylvinylpolysiloxane capped at both ends of its molecular chain with dimethylvinylsiloxy groups, dimethylsiloxane capped at both ends of its molecular chain with dimethylvinylsiloxy groups/methylvinylsiloxane copolymers, dimethylsiloxane capped at both ends of its molecular chain with dimethylvinylsiloxy groups/methylvinylsiloxane/methylphenylsiloxane copolymers, dimethylpolysiloxane capped at both ends of its molecular chain with divinylmethylsiloxy groups, dimethylsiloxane capped at both ends of its molecular chain with divinylmethylsiloxy groups/methylvinylsiloxane copolymers, dimethylpolysiloxane capped at both ends of its molecular chain with trivinylsiloxy groups, and dimethylsiloxane capped at both ends of its molecular chain with trivinylsiloxy groups/methylvinylsiloxane copolymers.

One of these second polysiloxanes may be used alone, or two or more of them may be used in combination.

The elastic layer may contain, in addition to the silicone rubber, various additives.

Examples of the additives include reinforcing agents (such as carbon black), fillers (such as calcium carbonate), softening agents (such as paraffin-based softening agents), processing aids (such as stearic acid), antioxidants (such as amine-based antioxidants), vulcanizing agents (such as sulfur, metal oxides, and peroxides), and functional fillers (such as alumina).

The thickness of the elastic layer is, for example, from 30 μm to 1 mm inclusive and is preferably from 100 μm to 500 μm inclusive.

(Surface Layer)

For example, the surface layer is configured to contain a heat-resistant parting material (surface layer-forming material).

Examples of the heat-resistant parting material include fluorocarbon rubber, fluorocarbon resins, silicone resins, and polyimide resins.

Of these, a fluorocarbon resin may be used as the heat-resistant parting material.

Specific examples of the fluorocarbon resin include tetrafluoroethylene/perfluoroalkyl vinyl ether copolymers (PFA), polytetrafluoroethylene (PTFE), tetrafluoroethylene/hexafluoropropylene copolymers (FEP), polyethylene/tetrafluoroethylene copolymers (ETFE), polyvinylidene fluoride (PVDF), polychlorotrifluoroethylene (PCTFE), and vinyl fluoride (PVF).

The thickness of the surface layer is 100 μm or less and is, for example, from 5 μm to 50 μm inclusive and preferably from 10 μm to 40 μm inclusive.

The surface layer may be formed using a known method and may be formed using, for example, a coating method.

The surface layer may be formed by preparing a tubular body serving as the surface layer in advance, forming a bonding layer on the inner surface of the tubular body, and covering the outer circumferential surface of the elastic layer with the tubular body. Alternatively, the surface layer may be formed by introducing functional groups such as vinyl groups into the inner circumferential surface of a tubular body, covering the outer circumferential surface of the elastic layer with the tubular body, and reacting the functional groups on the inner circumferential surface of the tubular body with functional groups on the outer circumferential surface of the elastic layer.

(Pressurized Hot-Water Durability Test Properties)

In the fixing member according to the present exemplary embodiment, when a pressurized hot-water durability test is performed at a pressure of 0.35 MPa and a temperature of 150° C., the time until the area of bonding between the elastic layer and the surface layer becomes less than 100% is 12 hours or longer (preferably 24 hours or longer). The upper limit of the above time is, for example, 200 hours.

Specifically, the pressurized hot-water durability test is performed as follows.

A test piece is cut from a fixing member used as a measurement target. The test piece is cut from the fixing member such that the axial length is 20 mm.

The test piece is placed in a steam autoclave having an internal environment at a pressure of 0.35 MPa and a temperature of 150° C. After the placement of the test piece, the test piece is removed from the autoclave after a lapse of prescribed time.

Then the "area of bonding between the base and the elastic layer" in the removed test piece is measured.

The "area of bonding between the base and the elastic layer" is measured as follows.

A 90° peel test is performed on the test piece. The 90° peel test is performed according to JIS-K-6854-1 in an atmosphere at a temperature of 15 to 25° C. and a humidity of 30 to 70% RH under the conditions of a tensile speed of 20 mm/min and a peel angle of 90°. In the 90° peel test, the base is fixed, and the elastic layer is pulled.

After the 90° peel test, the area ratio (%) of regions in which the elastic layer remains (elastic layer-remaining regions) is measured on the peeled surface on the base side and used as the "area of bonding between the base and the elastic layer."

The area ratio (%) of the elastic layer-remaining regions is measured as follows.

The peeled surface of the base is scanned with a scanner to obtain an image observed at 2×. The area of the regions in which the elastic layer remains is measured in a 20 mm×20 mm region in the image obtained.

The ratio (%) of the area of the elastic layer-remaining regions to the observation area is determined and used as the area ratio (%) of the elastic layer-remaining regions.

The above procedure is repeated, and the time until the area of bonding between the base and the elastic layer becomes less than 100% (the time from placement of the test piece in the steam autoclave to removal of the test piece (hereinafter referred to as "test time")) is determined.

In one method for allowing the fixing member according to the present exemplary embodiment to have the above-described pressurized hot-water durability test properties, a bonding layer that is a cured product of a composition containing the above-described organic titanate compound and contains a component originating from the organic titanate compound in an amount of from 5% by mass to 95% by mass inclusive is disposed between the base containing the polyimide resin and the elastic layer disposed on the base and containing the silicone rubber. However, this method is not a limitation.

(Applications of Fixing Member)

For example, the fixing member (fixing belt) according to the present exemplary embodiment is applicable to both a heating belt and a pressurizing belt. The heating belt may be a heating belt that uses electromagnetic induction for heating or may be a heating belt for which an external heat source for heating is used.

When the fixing member according to the present exemplary embodiment is applied to a heating belt that uses electromagnetic induction for heating, a metal layer (heat generating layer) that generates heat by electromagnetic induction may be provided.

[Fixing Device]

A fixing device according to an exemplary embodiment can have various structures. For example, the fixing device may include a first rotatable member and a second rotatable member disposed in contact with the outer surface of the first rotatable member, and a recording medium with a toner image formed on its surface is caused to pass through a contact portion between the first rotatable member and the second rotatable member to thereby fix the toner image. The fixing member according to the preceding exemplary embodiment is applied to at least one of the first rotatable member and the second rotatable member.

A description will be given of fixing devices in first and second exemplary embodiments each including a heating belt and a pressurizing roller. In the first and second exemplary embodiments, the fixing member according to the preceding exemplary embodiment is applicable to both the heating belt and the pressurizing roller.

The fixing device according to the present exemplary embodiment is not limited to the fixing devices in the first and second exemplary embodiments and may be a fixing device including a pressurizing belt and one of a heating roller and a heating belt. The fixing member according to the preceding exemplary embodiment is applicable to any of the heating roller, the heating belt, and the pressurizing belt.

The fixing device according to the present exemplary embodiment is not limited to the fixing devices in the first and second exemplary embodiments and is applicable to a fixing device of the electromagnetic induction heating type.

(First Exemplary Embodiment of Fixing Device)

Figure 2:
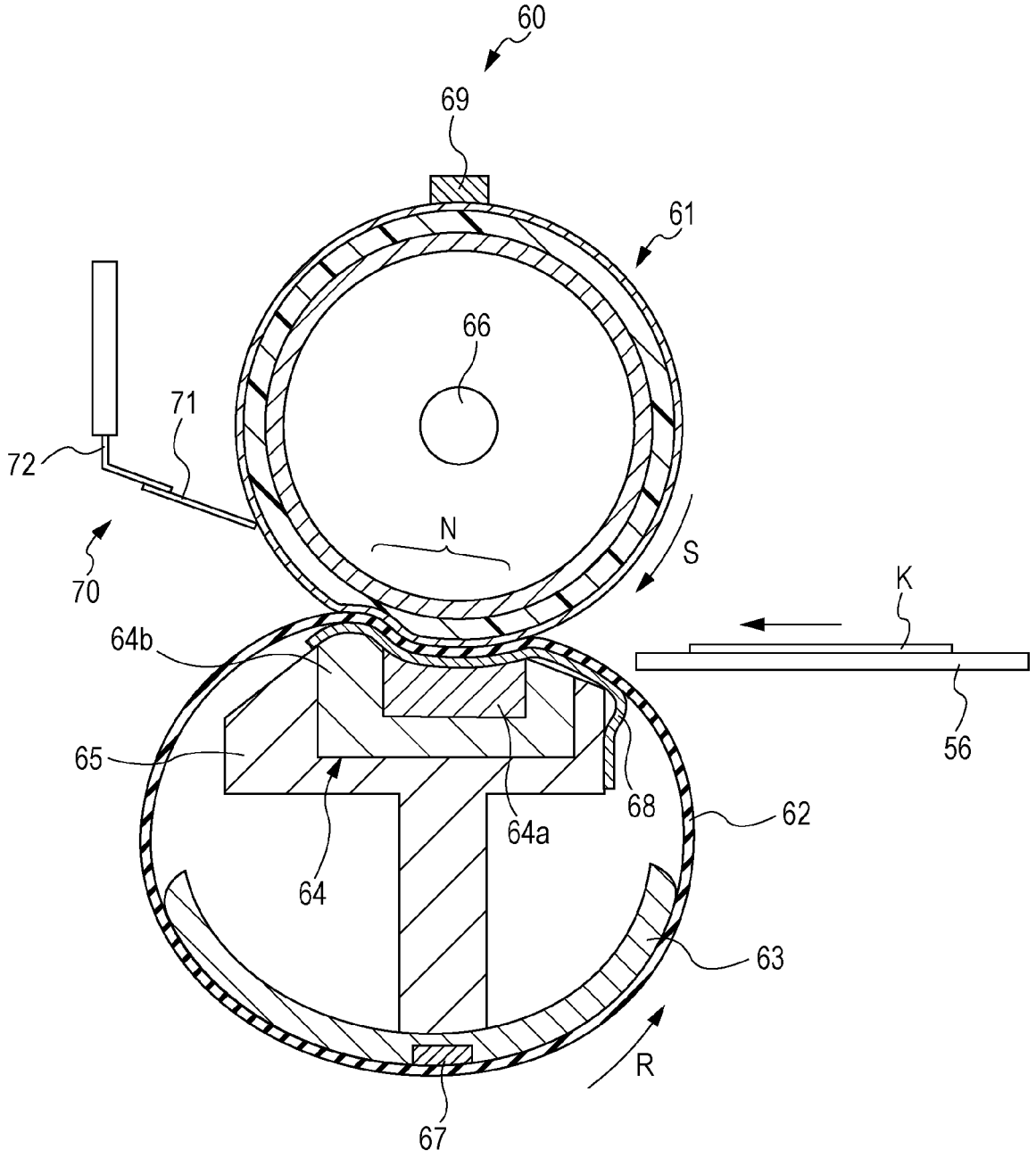
FIG. 2 is a schematic configuration diagram showing an example of a fixing device according to a first exemplary embodiment.

The fixing device according to the first exemplary embodiment will be described. FIG. 2 is a schematic illustration showing an example of the fixing device according to the first exemplary embodiment.

As shown in FIG. 2, the fixing device 60 according to the first exemplary embodiment includes, for example, a heating roller 61 (an example of the first rotatable member) for rotation driving, a pressurizing belt 62 (an example of the second rotatable member), and a pressing pad 64 (an example of a pressing member) that presses the heating roller 61 through the pressurizing belt 62.

It is only necessary that the pressing pad 64 be disposed, for example, such that the pressurizing belt 62 and the heating roller 61 are pressed against each other. Therefore, the pressurizing belt 62 may be pressed against the heating roller 61, or the heating roller 61 may be pressed against the pressurizing belt 62.

A halogen lamp 66 (an example of heating means) is disposed inside the heating roller 61. The heating means is not limited to the halogen lamp, and any other heat-generating member that generates heat may be used.

For example, a temperature sensing element 69 is disposed in contact with a surface of the heating roller 61. The halogen lamp 66 is turned on or off based on the temperature value measured by the temperature sensing element 69, and the surface temperature of the heating roller 61 is thereby maintained at a target temperature (e.g., 150° C.)

The pressurizing belt 62 is rotatably supported, for example, by the pressing pad 64 and a belt-running guide 63 that are disposed on the inner side of the pressurizing belt 62. The pressurizing belt 62 is disposed so as to be pressed against the heating roller 61 by the pressing pad 64 at a nip part N.

For example, the pressing pad 64 is disposed so as to be pressed against the heating roller 61 through the pressurizing belt 62 on the inner side of the pressurizing belt 62, and the nip part N is formed between the pressing pad 64 and the heating roller 61.

The pressing pad 64 includes, for example: a front nipping member 64*a* disposed on the entrance side of the nip part N to provide the wide nip part N; and a release nipping member 64*b* disposed on the exit side of the nip part N to distort the heating roller 61.

To reduce the sliding resistance between the inner circumferential surface of the pressurizing belt 62 and the pressing pad 64, a sheet-shaped sliding member 68, for example, is disposed on surfaces of the front nipping member 64*a* and the release nipping member 64*b* that are in contact with the pressurizing belt 62. The pressing pad 64 and the sliding member 68 are held by a metallic holding member 65.

For example, the sliding member 68 is disposed such that its sliding surface is in contact with the inner circumferential surface of the pressurizing belt 62 and participates in supply and maintenance of oil between the sliding member 68 and the pressurizing belt 62.

For example, the belt-running guide 63 is attached to the holding member 65 to allow the pressurizing belt 62 to rotate.

The heating roller 61 is rotated in the direction of an arrow S by, for example, an unillustrated driving motor, and the pressurizing belt 62 is driven by the rotation of the heating roller 61 and rotates in the direction of an arrow R that is opposite to the rotation direction of the heating roller 61. Specifically, for example, the heating roller 61 rotates in the clockwise direction in FIG. 2, and the pressurizing belt 62 rotates in the counterclockwise direction.

A paper sheet K (an example of the recording medium) with an unfixed toner image thereon is guided by, for example, a fixation entrance guide 56 and transported to the nip part N. When the paper sheet K passes through the nip part N, the unfixed toner image on the paper sheet K is fixed by pressure and heat applied to the nip part N.

In the fixing device 60 according to the first exemplary embodiment, for example, the front nipping member 64*a* having a concave shape conforming to the outer circumferential surface of the heating roller 61 allows the nip part N to have a larger area than that without the front nipping member 64*a*.

In the fixing device 60 according to the first exemplary embodiment, for example, the release nipping member 64*b* is disposed so as to protrude toward the outer circumferential surface of the heating roller 61, so that the distortion of the heating roller 61 increases locally in an exit region of the nip part N.

When the release nipping member 64*b* is disposed as described above, the paper sheet K subjected to fixation passes through the portion with large local distortion during passage through a release nipping region, and therefore the paper sheet K is easily released from the heating roller 61.

For example, a release member 70 used as auxiliary release means is disposed downstream of the nip part N of the heating roller 61. The release member 70 is held, for example, by a holding member 72 such that a release claw 71 extending in a direction (counter direction) opposite to the rotation direction of the heating roller 61 is disposed close to the heating roller 61.

(Second Exemplary Embodiment of Fixing Device)

Figure 3:
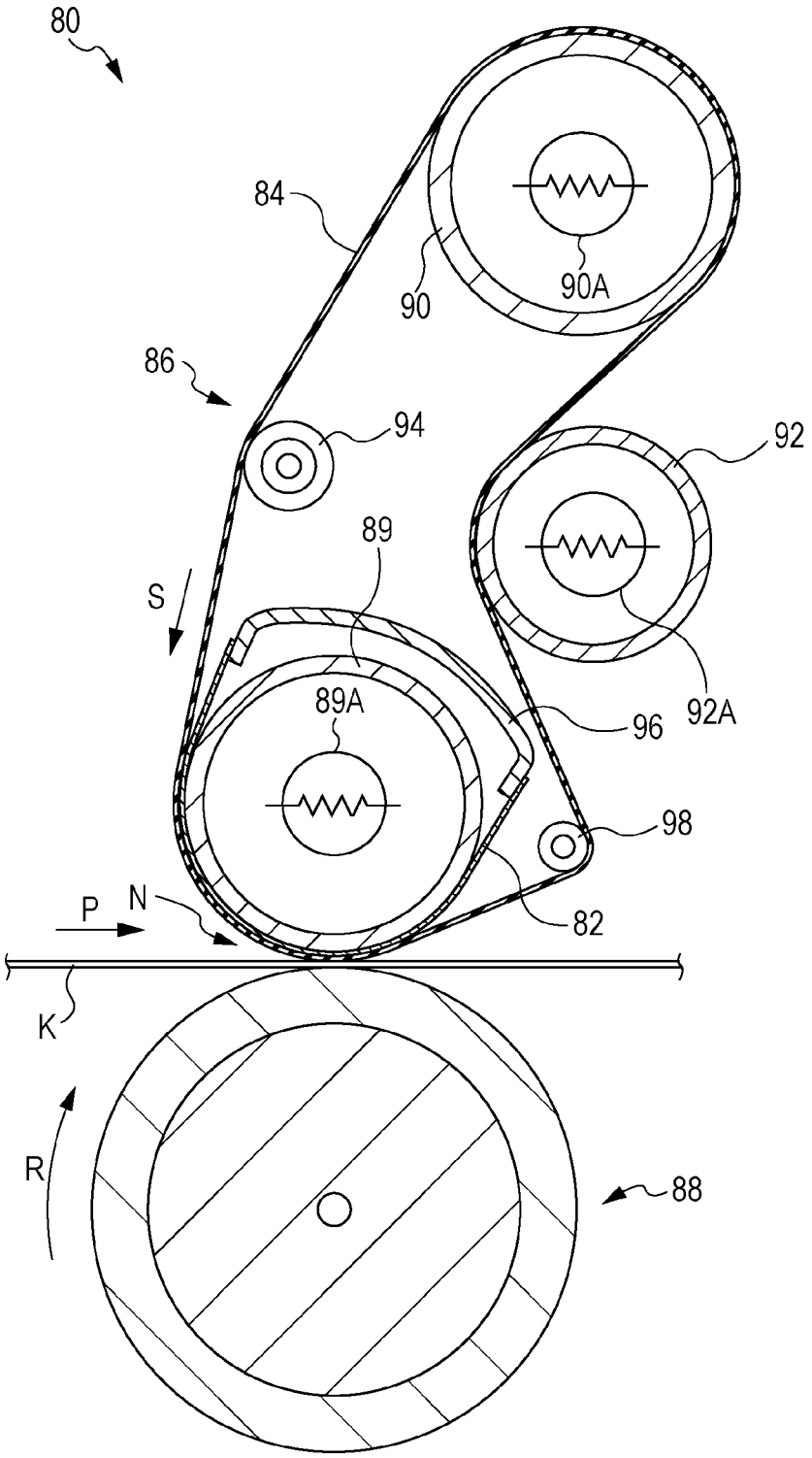
FIG. 3 is a schematic configuration diagram showing an example of a fixing device according to a second exemplary embodiment.

The fixing device according to the second exemplary embodiment will be described. FIG. 3 is a schematic illustration showing an example of the fixing device according to the second exemplary embodiment.

As shown in FIG. 3, the fixing device 80 according to the second exemplary embodiment includes, for example: a fixing belt module 86 including a heating belt 84 (an example of the first rotatable member); and a pressurizing roller 88 (an example of the second rotatable member) pressed against the heating belt 84 (the fixing belt module 86). For example, a nip part N is formed at a contact portion between the heating belt 84 (the fixing belt module 86) and the pressurizing roller 88. In the nip part N, a paper sheet K (an example of the recording medium) is pressurized and heated, and a toner image is thereby fixed.

The fixing belt module 86 includes, for example: the endless heating belt 84; a heat-pressing roller 89 which is disposed on the side toward the pressurizing roller 88, around which the heating belt 84 is wound, and which is driven to rotate by the rotating force of a motor (not shown) and presses the inner circumferential surface of the heating belt 84 toward the pressurizing roller 88; and a support roller 90 that supports the heating belt 84 from its inner side at a position different from the heat-pressing roller 89.

The fixing belt module 86 further includes, for example: a support roller 92 that is disposed on the outer side of the heating belt 84 and determines a circulating path of the heating belt 84; a trajectory correction roller 94 that corrects the trajectory of the heating belt 84 in a region between the heat-pressing roller 89 and the support roller 90; and a support roller 98 that applies tension to the heating belt 84 from its inner circumferential side at a position downstream of the nip part N formed by the heating belt 84 and the pressurizing roller 88.

For example, the fixing belt module 86 is disposed such that a sheet-shaped sliding member 82 is disposed between the heating belt 84 and the heat-pressing roller 89.

For example, the sliding member 82 is disposed such that its sliding surface is in contact with the inner circumferential surface of the heating belt 84 and participates in supply and maintenance of oil between the sliding member 82 and the heating belt 84.

For example, the sliding member 82 is disposed such that its opposite ends are supported by a support member 96.

For example, a halogen heater 89A (an example of the heating means) is disposed inside the heat-pressing roller 89.

The support roller 90 is, for example, a cylindrical roller made of aluminum, and a halogen heater 90A (an example of the heating means) is disposed thereinside to heat the heating belt 84 from its inner circumferential side.

For example, spring members (not shown) that press the heating belt 84 outward are disposed at opposite ends of the support roller 90.

The support roller 92 is, for example, a cylindrical roller made of aluminum, and a release layer made of a fluorocarbon resin and having a thickness of 20 μm is formed on a surface of the support roller 92.

For example, the release layer on the support roller 92 is formed in order to prevent toner and paper powder on the outer circumferential surface of the heating belt 84 from being deposited on the support roller 92.

For example, a halogen heater 92A (an example of the heating means) is disposed inside the support roller 92 and heats the heating belt 84 from its outer circumferential side.

Specifically, for example, the heating belt 84 is heated by the heat-pressing roller 89, the support roller 90, and the support roller 92.

The trajectory correction roller 94 is, for example, a cylindrical roller made of aluminum, and an edge position measuring mechanism (not shown) that measures an edge position of the heating belt 84 is disposed near the trajectory correction roller 94.

For example, an axial position changing mechanism (not shown) that changes the axial contact position of the heating belt 84 according to the results of measurement by the edge position measuring mechanism is disposed in the trajectory correction roller 94, and meandering of the heating belt 84 is thereby controlled.

For example, the pressurizing roller 88 is rotatably supported and is pressed by urging means such as an unillustrated spring against a portion of the heating belt 84 that is wound around the heat-pressing roller 89. Therefore, as the heating belt 84 (the heat-pressing roller 89) of the fixing belt module 86 rotates and moves in the direction of an arrow S, the pressurizing roller 88 driven by the heating belt 84 (the heat-pressing roller 89) rotates and moves in the direction of an arrow R.

A paper sheet K with an unfixed toner image (not shown) placed thereon is transferred in the direction of an arrow P and guided to the nip part N of the fixing device 80. When the paper sheet K passes through the nip part N, the toner image on the paper sheet K is fixed by pressure and heat applied to the nip part N.

In the description of the fixing device 80 according to the second exemplary embodiment, the halogen heaters (halogen lamps) are used as examples of the plural heating means, but this is not a limitation. Heating elements other than the halogen heaters may be used. Examples of such heating elements include radiation lamp heating elements (heating elements that emit radiation such as infrared radiation) and resistance heating elements (heating elements in which an electric current is applied to a resistor to generate Joule heat: e.g., a heating element prepared by forming a film with resistance on a ceramic substrate and then firing the resulting substrate).

[Image Forming Apparatus]

Next, an image forming apparatus according to an exemplary embodiment will be described.

The image forming apparatus according to the present exemplary embodiment includes: image holding members; charging means for charging the surfaces of the respective image holding members; electrostatic latent image forming means for forming electrostatic latent images on the charged surfaces of the respective image holding members; developing means for developing the electrostatic latent images formed on the surfaces of the image holding members with respective developers containing toner; transferring means for transferring the toner images onto a surface of a recording medium; and fixing means for fixing the toner images onto the recording medium.

The fixing device according to the preceding exemplary embodiment is used as the fixing means.

In the image forming apparatus according to the present exemplary embodiment, the fixing device may be a cartridge detachable from the image forming apparatus. Specifically, the image forming apparatus according to the present exemplary embodiment may include the fixing device according to the preceding exemplary embodiment as a constituent device of a process cartridge.

The image forming apparatus according to the present exemplary embodiment will be described with reference to FIG. 4.

Figure 4:
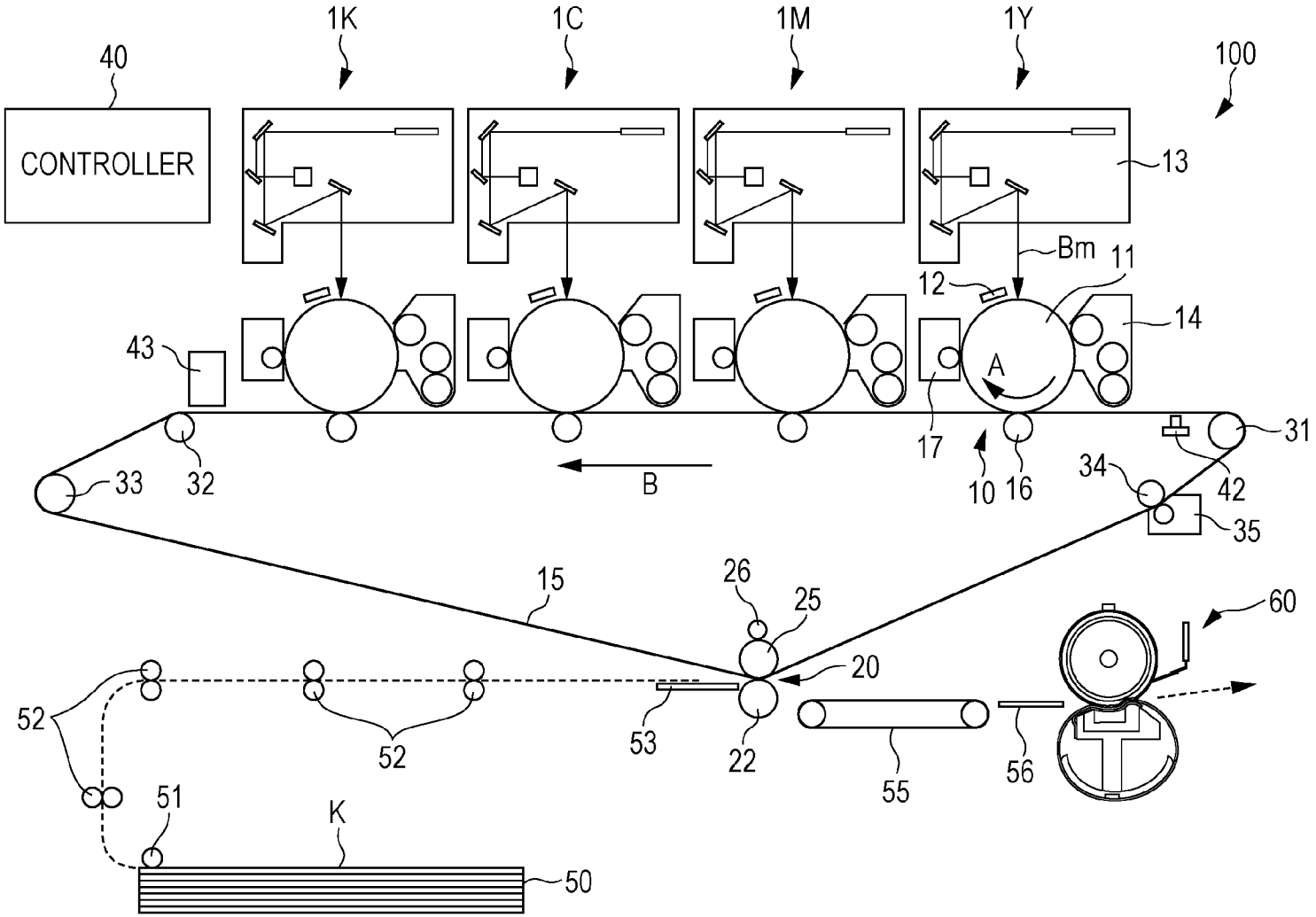
FIG. 4 is a schematic configuration diagram showing an example of an image forming apparatus according to an exemplary embodiment.

FIG. 4 is a schematic illustration showing the structure of the image forming apparatus according to the present exemplary embodiment.

As shown in FIG. 4, the image forming apparatus 100 according to the present exemplary embodiment is, for example, an intermediate transfer type image forming apparatus having a so-called tandem configuration and includes: a plurality of image forming units 1Y, 1M, 1C, and 1K that form toner images of respective colors by an electrophotographic process; first transfer units 10 that transfer (first-transfer) the color toner images formed by the image forming units 1Y, 1M, 1C, and 1K sequentially onto an intermediate transfer belt 15; a second transfer unit 20 that transfers (second-transfers) all the superposed toner images transferred onto the intermediate transfer belt 15 at once onto a paper sheet K used as a recording medium; and a fixing device 60 that fixes the second-transferred images onto the paper sheet K. The image forming apparatus 100 further includes a controller 40 that controls the operation of each device (each unit).

The fixing device 60 is the above-described fixing device 60 according to the first exemplary embodiment. The image forming apparatus 100 may include the above-described fixing device 80 according to the second exemplary embodiment.

Each of the image forming units 1Y, 1M, 1C, and 1K of the image forming apparatus 100 includes a photoreceptor 11 that rotates in the direction of an arrow A and serves as an example of the image holding members each of which holds a toner image formed on its surface.

A charging unit 12 that charges the photoreceptor 11 and serves as an example of the charging means is disposed near the circumference of the photoreceptor 11. A laser exposure unit 13 serving as an example of the latent image forming means and used to write an electrostatic latent image on the photoreceptor 11 is disposed above the photoreceptor 11 (in FIG. 4, an exposure beam is denoted by symbol Bm).

A developer 14 that serves as an example of the developing means, contains color toner, and visualizes the electrostatic latent image on the photoreceptor 11 with the toner is disposed near the circumference of the photoreceptor 11, and a first transfer roller 16 is provided which transfers the color toner image formed on the photoreceptor 11 onto the intermediate transfer belt 15 in a corresponding first transfer unit 10.

A photoreceptor cleaner 17 that removes the toner remaining on the photoreceptor 11 is disposed near the circumference of the photoreceptor 11, and the electrophotographic devices including the charging unit 12, the laser exposure unit 13, the developer 14, the first transfer roller 16, and the photoreceptor cleaner 17 are sequentially arranged in the rotation direction of the photoreceptor 11. The image forming units 1Y, 1M, 1C, and 1K are arrange substantially linearly in the order of yellow (Y), magenta (M), cyan (C), and black (K) from the upstream side of the intermediate transfer belt 15.

The intermediate transfer belt 15 serving as an intermediate transfer body is formed from a film-shaped pressurizing belt that includes a base layer made of a resin such as polyimide or polyamide and contains an appropriate amount of an antistatic agent such as carbon black. The intermediate transfer belt 15 is formed so as to have a volume resistivity of from $10^6$ Ω·cm to $10^{14}$ Ω·cm inclusive, and its thickness is, for example, about 0.1 mm.

The intermediate transfer belt 15 is circulated (rotated) by various rollers in a direction B shown in FIG. 4 at a speed appropriate for its intended use. These rollers include: a driving roller 31 driven by a motor (not shown) excellent in constant speed property to rotate the intermediate transfer belt 15; a support roller 32 that supports the intermediate transfer belt 15 extending substantially linearly in the arrangement direction of the photoreceptors 11; a tension applying roller 33 that applies tension to the intermediate transfer belt 15 and serves as a correction roller for preventing meandering of the intermediate transfer belt 15; a back roller 25 disposed in the second transfer unit 20; and a cleaning back roller 34 disposed in a cleaning unit in which toner remaining on the intermediate transfer belt 15 is scraped off.

Each first transfer unit 10 includes a corresponding first transfer roller 16 facing a corresponding photoreceptor 11 with the intermediate transfer belt 15 therebetween. The first transfer roller 16 includes a core and a sponge layer serving as an elastic layer adhering to the circumference of the core. The core is a cylindrical rod made of a metal such as iron or SUS. The sponge layer is formed of a rubber blend of NBR, SBR, and EPDM with a conducting agent such as carbon black added thereto and is a sponge-like cylindrical roller having a volume resistivity of from $10^{7.5}$ Ω·cm to $10^{8.5}$ Ω·cm inclusive.

The first transfer roller 16 is disposed so as to be pressed against the photoreceptor 11 with the intermediate transfer belt 15 therebetween, and a voltage (first transfer bias) with polarity opposite to the charge polarity of toner (negative polarity, the same applies to the following) is applied to the first transfer roller 16. Therefore, the toner images on the photoreceptors 11 are electrostatically attracted to the intermediate transfer belt 15 in a sequential manner, and the toner images are superposed on the intermediate transfer belt 15.

The second transfer unit 20 includes the back roller 25 and a second transfer roller 22 disposed on the toner image holding surface side of the intermediate transfer belt 15.

The surface of the back roller 25 is formed from a tube made of a rubber blend of EPDM and NBR with carbon dispersed therein, and the inner portion of the back roller 25 is made of EPDM rubber. The back roller 25 is formed such that its surface resistivity is from $10^7$ Ω/square to $10^{10}$ Ω/square inclusive, and its hardness is set to, for example, 70° (the ASKER C manufactured by Kobunshi Keiki Co., Ltd., the same applies to the following). The back roller 25 is disposed on the back side of the intermediate transfer belt 15 and forms a counter electrode of the second transfer roller 22, and a metallic feeding roller 26 to which a second transfer bias is stably applied is disposed in contact with the back roller 25.

The second transfer roller 22 includes a core and a sponge layer serving as an elastic layer adhering to the circumference of the core. The core is a cylindrical rod made of a metal such as iron or SUS. The sponge layer is formed of a rubber blend of NBR, SBR, and EPDM with a conducting agent such as carbon black added thereto and is a sponge-like cylindrical roller having a volume resistivity of from $10^{7.5}$ Ω·cm to $10^{8.5}$ Ω·cm inclusive.

The second transfer roller 22 is disposed so as to be pressed against the back roller 25 with the intermediate transfer belt 15 therebetween. The second transfer roller 22 is grounded, and the second transfer bias is formed between the second transfer roller 22 and the back roller 25, and the toner images are second-transferred onto a paper sheet K transferred to the second transfer unit 20.

An intermediate transfer belt cleaner 35 is disposed downstream of the second transfer unit 20 so as to be separable from the intermediate transfer belt 15. The intermediate transfer belt cleaner 35 removes toner and paper powder remaining on the intermediate transfer belt 15 after the second transfer to thereby clean the surface of the intermediate transfer belt 15.

The intermediate transfer belt 15, the first transfer units 10 (the first transfer rollers 16), and the second transfer unit 20 (the second transfer roller 22) correspond to examples of the transferring means.

A reference sensor (home position sensor) 42 that generates a reference signal used as a reference for image formation timings in the image forming units 1Y, 1M, 1C, and 1K is disposed upstream of the yellow image forming unit 1Y. When the reference sensor 42 detects a mark provided on the back side of the intermediate transfer belt 15, the reference sensor 42 generates the reference signal. The controller 40 issues instructions based on the reference signal to start image formation in the image forming units 1Y, 1M, 1C, and 1K.

An image density sensor 43 for image quality adjustment is disposed downstream of the black image forming unit 1K.

The image forming apparatus according to the present exemplary embodiment further includes, as transfer means for transferring a paper sheet K: a paper sheet container 50 that contains paper sheets K; a paper feed roller 51 that picks up and transfers the paper sheets K stacked in the paper sheet container 50 one by one at predetermined timing; transfer rollers 52 that transfer each paper sheet K fed by the paper feed roller 51; a transfer guide 53 that feeds the paper sheet K transferred by the transfer rollers 52 to the second transfer unit 20; a transfer belt 55 that transfers, to the fixing device 60, the paper sheet K transferred by the second transfer roller 22 after second transfer; and a fixation entrance guide 56 that guides the paper sheet K to the fixing device 60.

Next, a basic image forming process of the image forming apparatus according to the present exemplary embodiment will be described.

In the image forming apparatus according to the present exemplary embodiment, image data outputted from, for example, an unillustrated image reading device or an unillustrated personal computer (PC) is subjected to image processing in an unillustrated image processing device, and image forming operations are performed in the image forming units 1Y, 1M, 1C, and 1K.

In the image processing device, the inputted reflectance data is subjected to various types of image processing such as shading compensation, misregistration correction, lightness/color space transformation, gamma correction, frame erasure, and various types of image editing such as color editing and move editing. The image data subjected to the image processing is converted to four types of color tone data including Y color data, M color data, C color data, and K color data, and they are outputted to the respective laser exposure units 13.

In each of the laser exposure units 13, the photoreceptor 11 of a corresponding one of the image forming units 1Y, 1M, 1C, and 1K is irradiated with an exposure beam Bm emitted from, for example, a semiconductor laser according to the inputted color tone data. In each of the image forming units 1Y, 1M, 1C, and 1K, the surface of the photoreceptor 11 is charged by the charging unit 12 and is then scanned and exposed using the laser exposure unit 13, and an electrostatic latent image is thereby formed. The formed electrostatic latent images are developed in the respective image forming units 1Y, 1M, 1C, and 1K to thereby form Y, M, C, and K color images.

The toner images formed on the photoreceptors 11 of the image forming units 1Y, 1M, 1C, and 1K are transferred onto the intermediate transfer belt 15 in the first transfer units 10 in which the photoreceptors 11 come into contact with the intermediate transfer belt 15. More specifically, in each of the first transfer units 10, a voltage (first transfer bias) with polarity opposite to the charge polarity (negative polarity) of the toner is applied by the first transfer roller 16 to the base of the intermediate transfer belt 15. The toner images are thereby sequentially superposed onto the surface of the intermediate transfer belt 15, and the first transfer is completed.

After the toner images have been sequentially first-transferred onto the surface of the intermediate transfer belt 15, the intermediate transfer belt 15 moves, and the toner images are transferred toward the second transfer unit 20. When the toner images are conveyed toward the second transfer unit 20, the paper feed roller 51 in the transfer means starts rotating at the timing of conveyance of the toner images toward the second transfer unit 20 to feed a paper sheet K of the intended size from the paper sheet container 50. The paper sheet K fed by the paper feed roller 51 is conveyed by the transfer rollers 52 and reaches the second transfer unit 20 through the transfer guide 53. Before the paper sheet K reaches the second transfer unit 20, the paper sheet K is temporarily stopped. Then a registration roller (not shown) starts rotating at an appropriate timing determined by the movement of the intermediate transfer belt 15 with the toner images held thereon, and the position of the paper sheet K is thereby aligned with the position of the toner images.

In the second transfer unit 20, the second transfer roller 22 is pressed against the back roller 25 through the intermediate transfer belt 15. In this case, the paper sheet K transferred at the appropriate timing is pinched between the intermediate transfer belt 15 and the second transfer roller 22. Then, when a voltage (second transfer bias) with the same polarity as the charge polarity (negative polarity) of the toner is applied from the feeding roller 26, a transfer electric field is formed between the second transfer roller 22 and the back roller 25. All the unfixed toner images held on the intermediate transfer belt 15 are thereby electrostatically transferred at once onto the paper sheet K in the second transfer unit 20 in which the intermediate transfer belt 15 is pressed by the second transfer roller 22 and the back roller 25.

Then the paper sheet K with the toner images electrostatically transferred thereon is released from the intermediate transfer belt 15 and transferred by the second transfer roller 22 to the transfer belt 55 disposed downstream, with respect to the transfer direction of the paper sheet, of the second transfer roller 22. The transfer belt 55 transfers the paper sheet K to the fixing device 60 at an optimal transfer speed for the fixing device 60. The unfixed toner images on the paper sheet K transferred to the fixing device 60 are subjected to fixing processing using heat and pressure by the fixing device 60 and thereby fixed onto the paper sheet K. The paper sheet K with the fixed image formed thereon is transferred to an output sheet container (not shown) disposed in an output unit of the image forming apparatus.

After completion of transfer onto the paper sheet K, the toner remaining on the intermediate transfer belt 15 is transferred to the cleaning unit by the rotation of the intermediate transfer belt 15 and is removed from the intermediate transfer belt 15 by the cleaning back roller 34 and the intermediate transfer belt cleaner 35.

Although the exemplary embodiments have been described, the present disclosure is not to be construed as being limited to the exemplary embodiments, and various modifications, changes, and improvements are possible.

EXAMPLES

The present disclosure will be described more specifically by way of Examples, but the present disclosure is not limited to the following Examples. In the following description, "parts" and "%" are based on mass, unless otherwise specified.

Example 1

(Production of Base (PI Base))

An N-methyl-2-pyrrolidone (NMP) solution of a polyimide precursor (polyimide varnish "U-Varnish-S" manufactured by Ube Industries, Ltd.) is applied to a mold with a diameter of ϕ30 mm using a flow coater and heated stepwise to 380° C. to sinter the polyimide precursor. In the stepwise heating, the temperature is increased from 25° C. to 120° C., maintained at 120° C. for 1 hour, increased from 120° C. to 250° C., maintained at 250° C. for 1 hour, increased from 250° C. to 380° C., maintained at 380° C. for 1 hour, and reduced from 380° C. to 25° C.

In this manner, a tubular base formed from a single polyimide resin layer and having an outer diameter of 30 mm, a thickness of 60 μm, and a width of 400 mm is obtained.

(Formation of Bonding Layer, Elastic Layer, and Surface Layer)

Next, equal parts of A and B components of Primer No. 32 (manufactured by Shin-Etsu Chemical Co., Ltd.) used as an adhesive are weighed and stirred for 5 minutes to obtain a mixture of the A and B components of the Primer No. 32 (hereinafter referred to also as a Primer No. 32 A-B component mixture"). Then 50 parts of ORGATIX TA-8 (manufactured by Matsumoto Fine Chemical Co., tetraisobutyl titanate) used as the organic titanate compound is mixed with 100 parts of the solid content of the Primer No. 32 A-B component mixture to thereby obtain an adhesive coating solution (bonding layer-forming coating solution).

The adhesive coating solution obtained is applied to the outer circumferential surface of the base (the polyimide resin layer) by a cloth coating method, air-dried in an environment at a room temperature of 25° C. and a relative humidity of 50% for 30 minutes, and fired at 150° C. for 20 minutes to thereby form a coating having a thickness of 0.5 μm and serving as the bonding layer.

The Primer No. 32 manufactured by Shin-Etsu Chemical Co., Ltd. contains a compound corresponding to a SiH-containing siloxane polymer and a compound corresponding to tetraalkoxysilane that are contained in a general Si-based primer and further contains an alkenyl-based silane coupling agent.

Next, a raw material of low-hardness silicone rubber (X34-1053 manufactured by Shin-Etsu Chemical Co., Ltd.) is diluted to 15% by mass with butyl acetate to obtain an elastic layer-forming coating solution. The elastic layer-forming coating solution is applied to the surface (outer circumferential surface) of the coating serving as the bonding layer to a thickness of 200 μm using a spiral coater to form a coating.

The coating formed is subjected to self-leveling treatment (40° C.×20 minutes) and primary vulcanization (120° C.×20 minutes).

Next, the coating of the elastic layer-forming coating solution subjected to the self-leveling treatment and primary vulcanization is covered with a PFA cylindrical tube (thickness: 30 μm) having a bonding layer on its inner surface, and the product is fired at 200° C. for 4 hours.

In this manner, the bonding layer, the elastic layer, and the surface layer are sequentially formed on the outer circumferential surface of the base to thereby obtain a fixing belt.

In the fixing belt, the thickness of the bonding layer is 0.5 μm; the thickness of the elastic layer is 200 μm; and the thickness of the surface layer is 30 μm.

Example 2

A first coating solution is prepared by the same procedure as in Example 1 except that 75 parts of the ORGATIX TA-8 (manufactured by Matsumoto Fine Chemical Co., Ltd., tetraisobutyl titanate) used as the organic titanate compound is mixed with 100 parts of the solid content of the Primer No. 32 A-B component mixture, and a second coating solution is prepared by the same procedure as in Example 1 except that 25 parts of the ORGATIX TA-8 is mixed with 100 parts of the solid content of the Primer No. 32 A-B component mixture.

The first coating solution is applied to the outer circumferential surface of the base (polyimide resin layer), and the coating is dried. Then the second coating solution is applied to the dried coating, and the resulting coating is dried to thereby form a coating serving as a bonding layer and having a thickness of 0.5 μm. In the coating serving as the bonding layer and having a thickness of 0.5 μm, the thickness of the coating formed from the first coating solution is 0.2 μm, and the thickness of the coating formed from the second coating solution is 0.3 μm. The conditions for drying the coating solutions are the same as those in Example 1.

The same procedure as in Example 1 except for the above changes is repeated to obtain a fixing belt.

Example 3

A fixing belt is obtained by the same procedure as in Example 1 except that the number of parts of the ORGATIX TA-8 (manufactured by Matsumoto Fine Chemical Co., Ltd., tetraisobutyl titanate) used as the organic titanate compound is changed to 7 parts.

Example 4

A fixing belt is obtained by the same procedure as in Example 1 except that the number of parts of the ORGATIX TA-8 (manufactured by Matsumoto Fine Chemical Co., Ltd., tetraisobutyl titanate) used as the organic titanate compound is changed to 10 parts.

Example 5

A fixing belt is obtained by the same procedure as in Example 1 except that ORGATIX TA-21 (manufactured by Matsumoto Fine Chemical Co., Ltd., tetra n-butyl titanate) is used as the organic titanate compound.

Example 6

A fixing belt is obtained by the same procedure as in Example 1 except that ORGATIX TA-30 (manufactured by Matsumoto Fine Chemical Co., Ltd., tetraoctyl titanate) is used as the organic titanate compound.

Example 7

A fixing belt is obtained by the same procedure as in Example 1 except that silicone rubber (X34-2857 manufactured by Shin-Etsu Chemical Co., Ltd.) that uses metallic silicon as a high-thermal conductivity filler is used as the silicone rubber for the elastic layer.

Example 8

A fixing belt is obtained by the same procedure as in Example 2 except that the amount of TA-B mixed into the first coating solution is changed to 125 parts and the amount of TA-8 mixed into the second coating solution is changed to 10 parts.

Comparative Example 1

A fixing belt is obtained by the same procedure as in Example 1 except that no organic titanate compound is mixed.

Comparative Example 2

A fixing belt is obtained by the same procedure as in Example 1 except that the number of parts of the ORGATIX TA-8 (manufactured by Matsumoto Fine Chemical Co., Ltd., tetraisobutyl titanate) used as the organic titanate compound is changed to 3 parts.

Comparative Example 3

A fixing belt is obtained by the same procedure as in Example 1 except that the number of parts of the ORGATIX TA-8 (manufactured by Matsumoto Fine Chemical Co., Ltd., tetraisobutyl titanate) used as the organic titanate compound is changed to 1,600 parts.

(Evaluation Methods)

[Initial Adhesion]

Immediately after the production of each fixing belt, the fixing belt is cut to a width of 20 mm to obtain a test piece. A cut is made at the interface between the elastic layer and the base of the test piece, and a 90° peel test is performed with the elastic layer and the base held. The area ratio (%) of regions in which the elastic layer remains (elastic layer-remaining regions in which the elastic layer has undergone cohesive fracture) is measured on the peeled surface on the base side and used as the area of bonding between the base and the elastic layer.

The area ratio (%) of the regions in which the elastic layer remains (the elastic layer-remaining regions in which the elastic layer has undergone cohesive fracture) to the peeled surface on the base side is measured by the method described in the pressurized hot-water durability test properties.

[Bond Durability at High Temperature and High Humidity]

Immediately after the production of each fixing belt, the fixing belt is cut to a width of 20 mm to obtain a test piece.

The test piece is placed in a "highly accelerated stress test chamber" manufactured by ESPEC CORP., and a pressure cooker test (a test under the conditions of a temperature of 150° C., a humidity of 100% Rh, and a pressure of 0.35 MPa) is performed. The test piece placed in the chamber is removed from the chamber after a lapse of 100 hours.

The area ratio (%) of the regions in which the elastic layer remains (the elastic layer-remaining regions in which the elastic layer has undergone cohesive fracture) to the peeled surface on the base side is measured in the same manner as for the initial adhesion except that the above test piece is used. The measured area ratio (%) is used as the area of bonding between the base and the elastic layer.

(Pressurized Hot-Water Durability Test)

The pressurized hot-water durability test is performed by the method described above, and then the area of bonding between the base and the elastic layer is determined.

The test time of the test piece placed in the steam autoclave is 12 hours, 30 hours, 48 hours, 72 hours, or 100 hours.

A list of the Examples is shown in Table 1. The details of the abbreviations in Table 1 are as follows.

TA-8: ORGATIX TA-8(manufactured by Matsumoto Fine Chemical Co., Ltd., tetraisobutyl titanate)

TA-21: ORGATIX TA-21 (manufactured by Matsumoto Fine Chemical Co., Ltd., tetra n-butyl titanate)

TA-30: ORGATIX TA-30 (manufactured by Matsumoto Fine Chemical Co., Ltd., tetraoctyl titanate)

X34-1053: raw material of silicone rubber (X34-1053 manufactured by Shin-Etsu Chemical Co., Ltd.)

X34-2857: raw material of silicone rubber (X34-2857 manufactured by Shin-Etsu Chemical Co., Ltd.)

TABLE 1

| | Bonding layer formation conditions Organic titanate compound | | Bonding layer Content of component originating from organic titanate compound | | Elastic layer Silicone rubber | | Bond durability at high temperature and high humidity | Pressurized hot-water durability test Test time | | | | |
|---|---|---|---|---|---|---|---|---|---|---|---|---|
| | Type | Number of parts | Base side (% by mass) | Elastic layer side (% by mass) | Type of raw material | Initial adhesion | Area of bonding between base and elastic layer (%) | 12 hours | Test time 30 hours | Test time 48 hours | Test time 72 hours | Test time 100 hours |
| Example 1 | TA-8 | 50 | 55 | 45 | X34-1053 | 100 | 98 | 100 | 100 | 100 | 100 | 98 |
| Example 2 | TA-8 | 75/25 | 78 | 22 | X34-1053 | 100 | 99 | 100 | 100 | 100 | 100 | 99 |
| Example 3 | TA-8 | 7 | 6.5 | 6.5 | X34-1053 | 100 | 95 | 100 | 100 | 100 | 100 | 95 |
| Example 4 | TA-8 | 10 | 52 | 48 | X34-1053 | 100 | 95 | 100 | 100 | 100 | 100 | 95 |
| Example 5 | TA-21 | 50 | 56 | 44 | X34-1053 | 100 | 98 | 100 | 100 | 100 | 100 | 98 |
| Example 6 | TA-30 | 50 | 51 | 48 | X34-1053 | 100 | 99 | 100 | 100 | 100 | 100 | 99 |
| Example 7 | TA-8 | 50 | 53 | 47 | X34-2857 | 100 | 97 | 100 | 100 | 100 | 100 | 97 |

TABLE 1-continued

| | Bonding layer formation conditions Organic titanate compound | | Bonding layer Content of component originating from organic titanate compound | | Elastic layer Silicone rubber | | Bond durability at high temperature and high humidity | Pressurized hot-water durability test Test time | | | | |
|---|---|---|---|---|---|---|---|---|---|---|---|---|
| | Type | Number of parts | Base side (% by mass) | Elastic layer side (% by mass) | Type of raw material | Initial adhesion | Area of bonding between base and elastic layer (%) | 12 hours | Test time 30 hours | Test time 48 hours | Test time 72 hours | Test time 100 hours |
| Example 8 | TA-8 | 125/10 | 88 | 12 | X34-1053 | 100 | 99 | 100 | 100 | 100 | 100 | 99 |
| Comparative Example 1 | None | 0 | 0 | 0 | X34-1053 | 0 | 0 | 0 | 0 | 0 | 0 | 0 |
| Comparative Example 2 | TA-8 | 3 | 1 | 1 | X34-1053 | 80 | 40 | 70 | 60 | 55 | 50 | 40 |
| Comparative Example 3 | TA-8 | 1600 | 95.5 | 95.5 | X34-1053 | 20 | 9 | 17 | 15 | 13 | 10 | 9 |

As can be seen from the above results, in the belts in the Examples, the durability of the bond between the base and the elastic layer in a high-temperature high-humidity environment is better than that in the belts in the Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing member comprising:

a base containing a polyimide resin;

an elastic layer disposed on the base and containing silicone rubber; and a bonding layer that is disposed between the base and the elastic layer, is a cured product of a composition containing an organic titanate compound, and contains a component originating from the organic titanate compound in an amount of from 5% by mass to 95% by mass inclusive, wherein, in the bonding layer, a content of the component originating from the organic titanate compound is higher on a side toward the base than on a side toward the elastic layer.

2. The fixing member according to claim 1, wherein the organic titanate compound is an alkyl titanate.

3. The fixing member according to claim 2, wherein the alkyl titanate is a tetraalkyl titanate.

4. The fixing member according to claim 1, wherein, in the bonding layer, the content of the component originating from the organic titanate compound on the side toward the base is from 60% by mass to 95% by mass inclusive.

5. The fixing member according to claim 1, wherein the bonding layer is a cured product of a composition containing the organic titanate compound, a siloxane polymer having a SiH group, and a silane coupling agent.

6. A fixing device comprising:

a first rotatable member; and a second rotatable member disposed in contact with an outer surface of the first rotatable member, wherein at least one of the first rotatable member and the second rotatable member is the fixing member according to claim 1.

7. A process cartridge comprising:

the fixing device according to claim 6, wherein the fixing device is attached to and detached from an image forming apparatus.

8. An image forming apparatus comprising:

an image holding member;

a charging unit that electrostatically charges a surface of the image holding member;

a latent image forming unit that forms a latent image on the charged surface of the image holding member;

a developing unit that develops the latent image with toner to form a toner image;

a transfer unit that transfers the toner image onto a recording medium; and a fixing unit that fixes the toner image onto the recording medium, the fixing unit being the fixing device according to claim 6.

* * * * *